United States Patent [19]

Harnisch et al.

[11] Patent Number: 4,997,740

[45] Date of Patent: Mar. 5, 1991

[54] ELECTROPHOTOGRAPHIC TONERS WITH SUBSTITUTED 3-AMINO-1-IMINO-ISOINDOLENINE SALTS

[75] Inventors: Horst Harnisch, Much; Roderich Raue; Klaus Wunderlich, both of Leverkusen, all of Fed. Rep. of Germany

[73] Assignee: Bayer Aktiengesellschaft, Leverkusen, Fed. Rep. of Germany

[21] Appl. No.: 438,834

[22] Filed: Nov. 17, 1989

[30] Foreign Application Priority Data

Dec. 1, 1988 [DE] Fed. Rep. of Germany ..... 3840488

[51] Int. Cl.[5] ..... G03G 9/097

[52] U.S. Cl. ..... 430/110; 548/471; 548/482

[58] Field of Search ..... 430/110, 115

[56] References Cited

U.S. PATENT DOCUMENTS

| | | | |
|---|---|---|---|
| 2,752,346 | 6/1956 | Rosch et al. . | |
| 4,912,006 | 3/1990 | Breitschaft et al. | 430/110 |

FOREIGN PATENT DOCUMENTS

| | | | |
|---|---|---|---|
| 61-156137 | 7/1986 | Japan | 430/110 |
| 61-258268 | 11/1986 | Japan | 430/110 |
| 61-259265 | 11/1986 | Japan | 430/110 |
| 63-201665 | 8/1988 | Japan | 430/110 |
| 1-259387 | 10/1989 | Japan | 430/110 |

OTHER PUBLICATIONS

Patent Abstracts of Japan, vol.11, no. 49 (P-547) Feb. 14, 1987.

*Primary Examiner*—Roland Martin

*Attorney, Agent, or Firm*—Sprung Horn Kramer & Woods

[57] ABSTRACT

The invention relates to positively charged electrophotographic toners which, in addition to customary resin and pigment particles, contain an additive which intensifies the cationic charge, of the general formula (I)

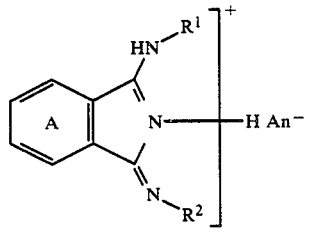

wherein $R^1$ and $R^2$ independently of one another represent H, $C_1$–$C_{22}$-alkyl, allyl, cyclohexyl, phenyl-$C_1$–$C_2$-alkyl or phenyl and $An^-$ denotes an anion, wherein the ring A and the cyclic and acyclic radicals can carry 1–2 nonionic substituents.

5 Claims, No Drawings

ELECTROPHOTOGRAPHIC TONERS WITH SUBSTITUTED 3-AMINO-1-IMINO-ISOINDOLENINE SALTS

The invention relates to positively charged electrophotographic toners which, in addition to customary resin and pigment particles, contain an additive which intensifies the cationic charge, of the general formula (I)

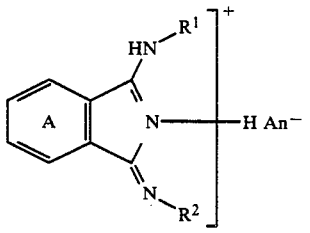

wherein $R^1$ and $R^2$ dependently of one another represent H, $C_1$–$C_{22}$-alkyl, allyl, cyclohexyl, phenyl-$C_1$–$C_2$-alkyl or phenyl and An⁻ denotes an anion, wherein the ring A and the cyclic and acyclic radicals can carry 1–2 nonionic substituents, and wherein the hydrogen on the bracket is located on a nitrogen atom.

Compounds of the formula (I) in which $R^1$ and $R^2$ independently of one another represent hydrogen, unsubstituted $C_4$–$C_{18}$-alkyl, benzyl or cyclohexyl and the nonionic substituents denote $C_1$–$C_4$-alkyl, $C_1$–$C_4$-alkoxy, hydroxyl, halogen, such as chlorine and bromine, cyano, a carbamoyl or sulphamoyl radical, which can be substituted by 1–2 $C_1$–$C_4$-alkyl radicals, $C_1$–$C_4$-alkoxycarbonyl or phenyl are particularly valued in industry.

Preferred substituents on alkyl radicals are hydroxyl, $C_1$–$C_4$-alkoxy, chlorine, cyano, carbamoyl or $C_1$–$C_2$-alkoxycarbonyl.

Suitable anions are the customary anions, such as halides, for example chloride, bromide and iodide, tetrafluoborates and anions of alkyl- and arylsulphonic acids, -carboxylic acids, -phosphoric acids and -phosphonic acids. Those anions which reduce the water-solubility of the compounds (I) are particularly suitable. The reduction in water-solubility can also be effected, however, by enlarging the alkyl radical $R^1$, that is to say, for example, choosing the radical in the range of $C_{98}$–$C_{22}$-alkyl. In this case, more hydrophilic anions, such as halides, are also most suitable.

The preferred water-solubility of the compounds (I) at 20° C. is under 3 % by weight, in particular under 1 % by weight. In addition to halides and tetrafluoborates, preferred anions are, in particular, arylsulphonates, such as optionally $C_1$–$C_{12}$-alkyl- or chlorinesubstituted benzenesulphonates, $C_5$–$C_{18}$-alkylsulphonates, salts of $C_5$–$C_{18}$-alkylcarboxylic acids and of condensation products of formaldehyde and arylsulphonic acids and/or optionally sulphonated 4,4,'-dihydroxydiphenylsulphone, as well as anions of heteropolyacids based on tungsten and/or molybdenum with phosphorus or silicon, in particular phosphotungsten molybdates.

Those compounds of the formula (I) wherein $R^2 = R^1$ are of particular industrial value.

The invention also relates to new compounds of the formula (II)

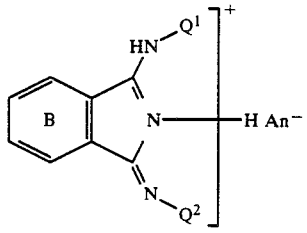

wherein

An⁻ represents an anion, $Q^1$ and $Q^2$ independently of one another represent $C_4$–$C_{18}$-alkyl, cyclohexyl or optionally methyl-, chlorine-, methoxy- or ethoxy-substituted benzyl, and the ring B can be substituted by methyl or chlorine.

The compounds of the formula (I) can be prepared by methods which are known per se, by a process in which compounds of the formula (III)

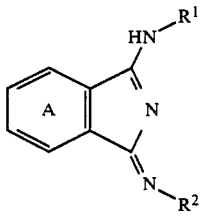

or a tautomer of (III), wherein $R^1$ and $R^2$ have the abovementioned meaning, are reacted with compounds of the formula HX, wherein X represents a group which forms an anion, and if appropriate the anion is then replaced.

The reaction is advantageously carried out in an inert organic solvent in the temperature range from 10°–200° C., preferably at 20°–140° C.

The reaction product (I) as a rule crystallizes out of the reaction solution and can be isolated therefrom by filtration. However, it is also possible to evaporate the solution in a paddle dryer and to obtain (I) in this manner as a crystalline powder.

The starting compounds where R is not H can be prepared by a process in which a compound of the formula (IV)

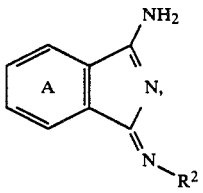

wherein $R^2$ has the abovementioned meaning, is subjected to a condensation reaction with a primary amine of the formula $$R^1—NH_2 \quad (V),$$

ammonia being split off.

This reaction is also advantageously carried out in an inert solvent in the temperature range from 50 to 150° C., preferably at 70°–130° C.

Compounds of the formula (IV) or tautomers of (IV) are prepared by a process in which a compound of the formula

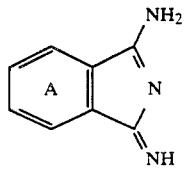

(VI)

is subjected to a condensation reaction with a primary amine of the formula $$R^2—NH_2 \quad \text{(VII)},$$

wherein $R^2$ has the abovementioned meaning, ammonia being split off.

This reaction is advantageously carried out under conditions which are similar to or the same as those for the reaction of (IV) and (V).

If the preferred case where $R^1=R^2$ exists, (VI) is advantageously condensed with 2 equivalents of $R^1—NH_2$.

A preferred embodiment of the process for the preparation of (I) where $R^2=R^1$ comprises a process in which (IV) is first subjected to a condensation reaction with 2 equivalents of $R^2—NH_2$ and the compound (III) thus obtained is further reacted with HX in the same reaction medium without intermediate isolation, and if desired the anion is then replaced, for example analogously to DE-A 3,738,948.

Examples of suitable inert solvents are sulpholane, aromatics, such as toluene, chlorobenzene, o-dichlorobenzene, trichlorobenzenes and xylene, alkanols, such as ethanol, propanol, isopropanol, n-butanol, 2-methoxyethanol and 2-ethoxyethanol, alkanediols, such as ethylene glycol, dialkoxyalkanes, such as ethylene glycol dimethyl ether, nitriles, such as acetonitrile, chlorinated aliphatics, such as methylene chloride or chloroform, and dipolar aprotic solvents, such as dimethylformamide, N-methylpyrrolidone or dimethylsulphoxide.

The compounds of the formula (I) are usually colourless or only slightly coloured. Compounds of the formula (I) in which $R^1$ and $R^2$ represent phenyl have an intrinsic yellowish colour.

Charge-intensifying additives for electrophotographic toners, also called charge control substances, are already known. They are described, for example, in DE-A 3,604,827 and 3,738,948, in EP-A 233,544, in US-A 3,893,935, 3,944,493, 4,007,293, 4,079,014, 4,265,990, 4,298,672, 4,338,390, 4,394,430 and 4,493,883 and in JA-A 61-156,144.

Latent electrostatic image recordings are developed by a procedure in which the toner is deposited inductively on the electrostatic image. The charge control substances intensify the cationic charge of the toner. The image in this way becomes deeper with sharper contours.

The resins contained in the toners are known. They are thermoplastic and have a softening point between 50 and 130° C., preferably between 65 and 115° C. Examples of such resins include polystyrene, copolymers of styrene with an acrylate or methacrylate, copolymers of styrene with butadiene and/or acrylonitrile, polyacrylates and polymethacrylates, copolymers of an acrylate or methacrylate with vinyl chloride or vinyl acetate, polyvinyl chloride, copolymers of vinyl chloride with vinylidene chloride, copolymers of vinyl chloride with vinyl acetate, polyester resins (U.S. Pat. specification No. 3,590,000), epoxy resins, polyamides and polyurethanes.

In addition to the compounds (I) and the thermoplastic resins, the toners according to the invention contain the known amounts of colouring materials and if appropriate magnetically attractable material. The colouring material can consist of an organic dyestuff, such as nigrosine, aniline blue, 2,9-dimethylquinacridone, C.I. Disperse Red 15 (=C.I. 60 10), C.I. Solvent Red 19 (=C.I. 26 050), C.I. Pigment Blue 15 (=C.I. 74 160), C.I. Pigment Blue 22 (=C.I. 69 810) and C.I. Solvent Yellow 16 (=C.I. 12 700), or an inorganic pigment, such as carbon black, red lead, yellow lead dioxide or chromium yellow. The amount of colouring material present in the toner generally does not exceed about 15 % by weight.

The magnetically attractable material can consist, for example, of iron, nickel, chromium oxide, iron oxide or a ferrite of the general formula $MFe_2O_4$, wherein M represents a divalent metal, such as iron, cobalt, zinc, nickel or manganese.

The toners containing the compounds (I) are prepared by customary processes, for example by mixing the constituents in a kneader and then pulverizing the mixture or by melting the thermoplastic resin or a mixture of the thermoplastic resin, subsequently finely dividing one or more charge control substances of the formula (I) and the other additives, if used, in the molten resin using the mixing and kneading machines known for this purpose, then cooling the melt to a solid mass and finally grinding the solid mass to give particles of the desired particle size. It is also possible for the thermoplastic resin and the compound (I) to be suspended in a common solvent and to incorporate the other additives into the suspension. The suspension can thus be used as a liquid toner.

However, the liquid can also be spray-dried in a manner which is known per se or the solvents can be evaporated off and the solid residue ground to particles of the desired particle size.

In accordance with a modification of this preparation process, the charge control substance of the formula (I) is not dissolved but is finely dispersed in the solution of the thermoplastic resin.

The toner formulation thus obtained is then employed in a xerographic image recording system, for example analogously to U.S. Pat. specification No. 4,265,990.

The charge control substances used must meet diverse requirements.

1. Ability to develop the latent electrostatic image to give a deep-coloured visible image.

2. Ability to be distributed readily in the toner formulation and uniform distribution on the image surface, in order to produce an interference-free uniform image of sharp contours.

3. Insensitivity towards moisture.

4. High heat stability.

5. Stability towards the hot mixture of lead dioxide and a vinylidene fluoride/hexafluoropropylene copolymer resin (for example VITON$^R$E430 from Dupont) with which the image can be fixed with the aid of a hot roll. The coating composition should not become black-coloured from decomposition products.

The charge control substances known from the abovementioned patent specifications and Offenlegungsschriften (published specifications) do not meet all these requirements.

Surprisingly, it has now been found that the substances of the formula (I) show a further improvement in image sharpness, an even lower sensitivity towards high atmospheric humidity and an even higher life of the toner (more than 70,000 copies) compared with the previously known cationic compounds mentioned.

EXAMPLE 1

110 g of 92 % pure 3-amino-1-imino-isoindolenine (0.7 mol) are heated at the boiling point under reflux in 700 ml of isopropanol with 160 g of cyclohexylamine (about 1.6 mol) for 16 hours, ammonia escaping and a clear slightly greenish solution being formed. A thin layer chromatogram of a 5 % strength methanolic solution in a mobile phase mixture of 350 ml of butyl acetate, 100 ml of water, 250 ml of glacial acetic acid and 100 ml of formic acid shows a practically uniform conversion into the compound of the formula (1A)

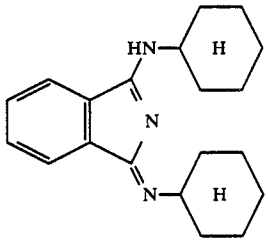

$C_{20}H_{25}N_3$ (307.44) m/e=307 ($M^+$).

A total of 171 g of p-toluenesulphonic acid monohydrate (0.9 mol) are added to the solution in small portions, starting at 40° C., and the mixture is heated briefly to 85° C., cooled to room temperature and stirred at 20° C. for 5 hours and at 5° C. for 1 hour. The colourless crystalline precipitate is filtered off with suction, washed with ice-cold isopropanol and dried at 50° C. in vacuo. 283 g, corresponding to 84 % of theory, of the compound of the formula (1)

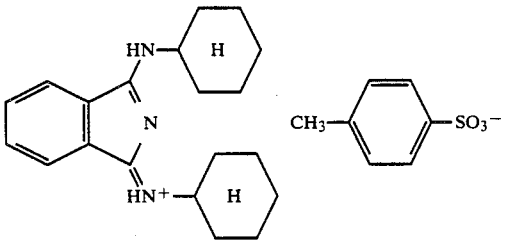

are obtained as a colourless crystalline powder of melting point 235°-237° C. (from isopropanol).

EXAMPLE 2

Example 1 is repeated, but 1.6 mol of benzylamine are employed instead of the cyclohexylamine. 286 g (82 % of theory) of the compound of the formula (2)

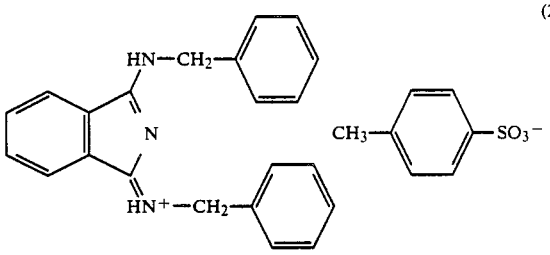

are obtained as colourless crystals of melting point 217°-218° C.

EXAMPLE 3

The procedure is as in Example 1, but 1.6 mol of hexadecylamine are employed instead of the cyclohexylamine. 424 g (79 % of theory) of the compound of the formula (3)

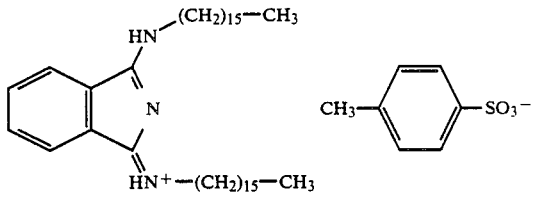

are obtained as colourless crystals of melting point 81°-83°C.

The following compounds of the formula

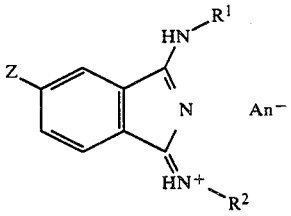

are also prepared analogously to Example 1.

| Example | Z | $R^1$ | $R^2$ | $An^-$ |
|---|---|---|---|---|
| 4 | H | $CH_3(CH_2)_3$— | $CH_3(CH_2)_3$— | 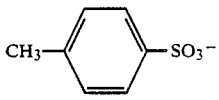 |
| 5 | H | $CH_3(CH_2)_7$— | $CH_3(CH_2)_7$— | 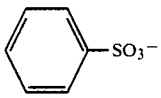 |

-continued

| Example | Z | $R^1$ | $R^2$ | $An^-$ |
|---|---|---|---|---|
| 6 | H | $CH_3(CH_2)_{11}$— | $CH_3(CH_2)_{11}$— | $NH_2SO_3^-$ |
| 7 | H | $CH_3(CH_2)_{17}$— | $CH_3(CH_2)_{17}$— | $Br^-$ |
| 8 | H | $CH_3(CH_2)_{21}$— | $CH_3(CH_2)_{21}$— | 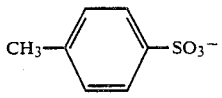 |
| 9 | H | 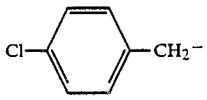 | 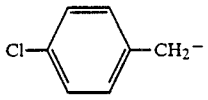 | $BF_4^-$ |
| 10 | NC— | 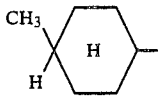 | 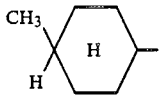 | $I^-$ |
| 11 | H | 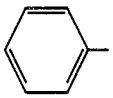 | 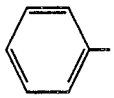 | 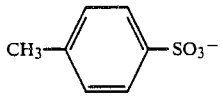 |
| 12 | Cl | $CH_3$— | $CH_3$— | $CH_3$—$SO_3^-$ |
| 13 | $CH_3$ | $CH_2$=CH—$CH_2$— | $CH_2$=CH—$CH_2$— | $Br^-$ |
| 14 | H | 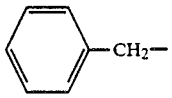 | $CH_3$—$(CH_2)_{15}$— | 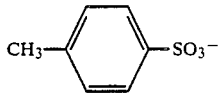 |
| 15 | H | 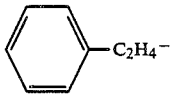 | 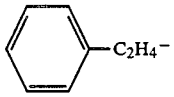 | $Cl^-$ |

EXAMPLE 16

(a) Preparation of a phosohotunqstomolvbdate solution:

1290 g of water are initially introduced into a reaction vessel and 8.5 g of sodium hydroxide (0.2 mol) are added. The solution is heated to 90° C. 416.4 g of ammonium tungstate solution (50 % of $WO_3$, corresponding to 230.7 g, 100 % pure, corresponding to 1 mol), 28.5 g of molybdenum 6-oxide (about 0.2 mol), 35.7 g of disodium hydrogen phosphate dihydrate, 27.9 g of crude hydrochloric acid (32 % strength, corresponding to 0.24 mol) and 53.6 g of 40 % strength sodium bisulphite solution (0.2 mol) are then introduced in the sequence shown, the solution is heated at the boiling point (about 102° C.) for 30 minutes and cooled to 30° C. and the pH is brought to 4 with about 6.2 ml of hydrochloric acid (about 32 % strength).

(b) Precipitation 148 g of 98 % pure 3-amino-1-imino-isoindolenine (1 mol) are dissolved in 2 l of water at 60° C. 1600 ml of the solution prepared under a) are allowed to run at 50°-55° C. in the course of 30-60 minutes, while stirring, into the solution thus prepared. The reaction product crystallizes out and the pH rises to >4. The pH is brought to 3.3 by dropwise addition of about 5.7 ml of hydrochloric acid and the suspension is subsequently stirred at 50°-55°C. for 30 minutes. The crystalline precipitate is filtered off with suction at 30° C., washed with a total of 1000 ml of water in 5 portions and dried at 80° C. in vacuo.

Yield: 183 g of the compound of the formula

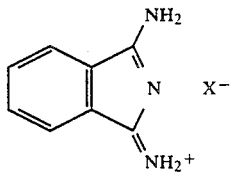

(16)

$X^-$ = phosphotungstomolybdate anion

EXAMPLE 17

165.2 g of anhydrous p-toluenesulphonic acid are introduced into 200 ml of dimethylformamide, and a solution, prepared at 70° C., of 116.0 g of 3-amino-1-iminoisoindolenine in 800 ml of dimethylformamide is added at 80° C. After dilution with 400 ml of dimethylformamide, the mixture is stirred at 80° C. for ½ an hour and cooled to room temperature. After stirring for a further 3.5 hours, the precipitate is filtered off with suction and washed with 200 ml of dimethylformamide and then with acetone. After drying at 70° C., 190.0 g of the compound of the formula

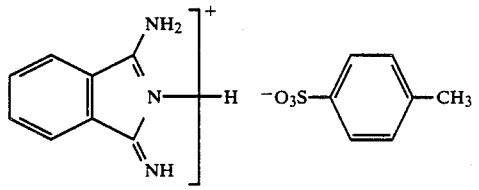

are obtained.

| Elemental analysis: | | C | H | N | 0 | S | |
|---|---|---|---|---|---|---|---|
| | calc. | 56.8 | 4.7 | 13.3 | 15.1 | 10.1 | % |
| | found | 54.3 | 5.0 | 12.4 | 16.4 | 10.9 | % |

EXAMPLE 18

23.3 g of amidosulphonic acid are dissolved in 75 ml of dimethylformamide and a solution, prepared at 80° C., of 29.0 g of 3-amino-1-imino-isoindolenine in 200 ml of dimethylformamide is then added. After the mixture has been stirred at 65° C. for 3 hours, it is cooled to room temperature. It is diluted with 250 ml of acetone and, after stirring for ¼ hour, the precipitate is filtered off with suction. After washing with 100 ml of acetone and drying at 60° C., 32.7 g of the compound of the formula

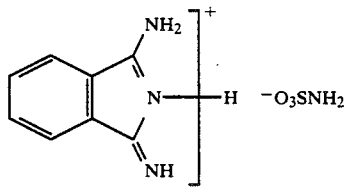

are obtained.

| Elemental analysis: | | C | H | N | 0 | S | |
|---|---|---|---|---|---|---|---|
| | calc. | 39.7 | 4.1 | 23.1 | 19.8 | 13.2 | % |
| | found | 39.4 | 4.0 | 23.1 | 19.9 | 13.2 | % |

USE EXAMPLE A 100 g of styrene/n-butyl methacrylate copolymer (mol: 50,000) and 5 g of the phosphotungstomolybdate mentioned in Example 16 are uniformly mixed in a kneader. After cooling, the resin is pulverized to an average particle fineness of 12 μ in a jet mill. 5 g of this toner powder are charged with 95 g of a carrier material of iron with a polymer coating by rotation and the charge is determined by the blow-off method. It is 20.2 μC/g and is still unchanged at this high level after 70,000 copies.

If a compound described in the other examples is employed instead of the compound of Example 16, similarly good charging effects are obtained.

USE EXAMPLE B 2 per cent by weight of the compound of Example 1, 6 % by weight of carbon black and 92 % by weight of a styrene/butadiene resin containing 89 % by weight of styrene and 11 % by weight of butadiene are melted and kneaded in an extruder at 100° C. and the mixture is then comminuted and ground until the particle diameter is less than 5 μ.

This toner formulation is incorporated into a xerographic image recording system as described in US-A 4,265,990. For this, a procedure is followed in which a MYLAR$^R$ substrate is provided with a layer, which generates a charge when exposed to light, of polyvinylcarbazole in which trigonal selenium is freely dispersed, and a transparent charge-transporting layer which contains N,N,-diphenyl-N,N'-bis(3-methylphenyl)-1,1,-bisphenyl-4,4,-diamine, as the charge-transporting molecules, dispersed in a MAKROLON$^R$ polycarbonate composition, is applied on top.

Needle-sharp image recordings are obtained.

We claim:

1. Electrophotographic toners which contain an additive which intensifies the cationic charge, of the general formula

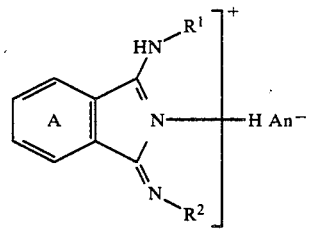

wherein $R^1$ and $R^2$ independently of one another represent H, $C_1$–$C_{22}$-alkyl, allyl, cyclohexyl, phenyl-$C_1$—$C_2$-alkyl or phenyl and An$^-$ denotes an anion, wherein the ring A and the cyclic and acyclic radicals can carry 1–2 nonionic substituents, and wherein the hydrogen on the bracket is located on a nitrogen atom.

2. Electrophotographic toners according to claim 1, characterized in that $R^1$ and $R^2$ independently of one another represent hydrogen, unsubstituted $C_4$ –$C_{18}$-alkyl, benzyl or cyclohexyl and the nonionic substituents denote $C_1$–$C_4$-alkyl, $C_1$–$C_4$-alkoxy, hydroxyl, halogen, such as chlorine and bromine, cyano, a carbamoyl or sulphamoyl radical, which can be substituted by 1–2 $C_1$–$C_4$-alkyl radicals, $C_1$–$C_4$-alkoxy-carbonyl or phenyl.

3. Electrophotographic toners according to claim 1, characterized in that $R^1 = R^2$.

4. Electrophotographic toners according to claim 1, characterized in that, in addition to the additive which intensifies the cationic charge, they contain resin and pigment particles.

5. An electrophotographic toner according to claim 1, characterized in that $R^1$ and $R^2$ independently of one another represent chlorine and bromine.

* * * * *